US010134318B2

(12) United States Patent
Kim et al.

(10) Patent No.: US 10,134,318 B2
(45) Date of Patent: Nov. 20, 2018

(54) DISPLAY DEVICE AND DRIVING METHOD THEREOF

(71) Applicant: SAMSUNG DISPLAY CO., LTD., Yongin, Gyeonggi-Do (KR)

(72) Inventors: Yang-Wan Kim, Yongin (KR); Won-Kyu Kwak, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 114 days.

(21) Appl. No.: 14/615,373

(22) Filed: Feb. 5, 2015

(65) Prior Publication Data

US 2015/0287383 A1 Oct. 8, 2015

(30) Foreign Application Priority Data

Apr. 7, 2014 (KR) ..... 10-2014-0041034

(51) Int. Cl.
*G09G 5/00* (2006.01)
*G09G 3/20* (2006.01)

(52) U.S. Cl.
CPC ..... *G09G 3/20* (2013.01); *G09G 2310/027* (2013.01); *G09G 2310/0221* (2013.01); *G09G 2310/0245* (2013.01); *G09G 2310/0251* (2013.01); *G09G 2310/0291* (2013.01); *G09G 2320/0686* (2013.01); *G09G 2330/021* (2013.01)

(58) Field of Classification Search
None
See application file for complete search history.

(56) References Cited

U.S. PATENT DOCUMENTS

2002/0126114 A1* 9/2002 Yatabe ..... G09G 3/367 345/212
2004/0222962 A1* 11/2004 Hirakata ..... G09G 3/20 345/103
2005/0225526 A1* 10/2005 Chiu ..... G09G 3/3688 345/98
2007/0063959 A1* 3/2007 Iwabuchi ..... G09G 3/2074 345/100
2009/0135169 A1* 5/2009 Hiratsuka ..... G09G 3/3688 345/208

(Continued)

FOREIGN PATENT DOCUMENTS

KR 10-0573160 B1 4/2006
KR 10-2007-0070818 A 7/2007

(Continued)

*Primary Examiner* — Christopher R Lamb
(74) *Attorney, Agent, or Firm* — Lewis Roca Rothgerber Christie LLP

(57) ABSTRACT

A display device includes: a display unit including a first display area and a second display area; and a data driver configured to supply a data signal to the display unit, wherein the data driver includes: a data signal generator configured to generate the data signal in response to input data; a first buffer unit and a second buffer unit configured to supply the data signal from the data signal generator to the first display area and the second display area, respectively, and to be turned off during a non-display period of a corresponding display area; and a sub driver configured to supply a black data signal to the first or second display area during the non-display period of the corresponding display area.

12 Claims, 5 Drawing Sheets

(56) References Cited

U.S. PATENT DOCUMENTS

| | | | | |
|---|---|---|---|---|
| 2011/0058024 | A1* | 3/2011 | Choi | G09G 3/003 348/51 |
| 2012/0001950 | A1 | 1/2012 | Kim | |
| 2014/0267091 | A1* | 9/2014 | Kim | G06F 1/1652 345/173 |
| 2015/0130851 | A1 | 5/2015 | Jeong et al. | |

FOREIGN PATENT DOCUMENTS

| | | | |
|---|---|---|---|
| KR | 10-2008-0050878 | A | 6/2008 |
| KR | 10-2009-0090677 | A | 8/2009 |
| KR | 10-2012-0002069 | A | 1/2012 |

* cited by examiner

DISPLAY DEVICE AND DRIVING METHOD THEREOF

CROSS-REFERENCE TO RELATED APPLICATION

This application claims priority to and the benefit of Korean Patent Application No. 10-2014-0041034, filed on Apr. 7, 2014, in the Korean Intellectual Property Office, the entire contents of which are incorporated herein by reference.

BACKGROUND

1. Field

Aspects of embodiments of the present invention relate to a display device and a driving method thereof.

2. Description of the Related Art

Recently, as display devices have become widely utilized in various electronic devices including portable terminals, research for efficiently utilizing the display area of display devices and decreasing power consumption has been actively conducted.

To this end, some display devices may be designed to include a main display area and an auxiliary display area, which may be independently driven.

SUMMARY

Aspects of embodiments of the present invention include a display device including a plurality of independently drivable display areas, which may effectively decrease power consumption, and a driving method thereof.

Aspects of example embodiments of the present invention include a display device including: a display unit including a first display area and a second display area; and a data driver configured to supply a data signal to the display unit, in which the data driver includes: a data signal generator configured to generate the data signal in response to input data; a first buffer unit and a second buffer unit configured to supply the data signal from the data signal generator to the first display area and the second display area, respectively, and to be turned off during a non-display period of a corresponding display area; and a sub driver configured to supply a black data signal to the first or second display area during the non-display period of the corresponding display area.

According to the exemplary embodiment, the sub driver may include: a first controller configured to supply the black data signal to the first display area during the non-display period of the first display area; a first switch unit configured to couple data lines of the first display area and the first controller during the non-display period of the first display area; a second controller configured to supply the black data signal to the second display area during the non-display period of the second display area; and a second switch unit configured to couple data lines of the second display area and the second controller during the non-display period of the second display area.

According to the exemplary embodiment, each of the first and second controllers may include a plurality of buffers configured to supply a control signal and the black data signal to the first and second switch units.

According to the exemplary embodiment, each of the first and second switch units may include a plurality of switches configured to be turned on in response to control signals from the first and second controllers, respectively.

According to the exemplary embodiment, each of the switches may include a first electrode for receiving the black data signal from the first or second controller, a second electrode coupled to a corresponding data line of the first or second display area, and a gate electrode for receiving a control signal from the first or second controller.

According to the exemplary embodiment, the first and second buffer units may be independently turned on/off.

According to the exemplary embodiment, the data signal generator may include a first data signal generator configured to generate a first data signal corresponding to the first display area, and a second data signal generator configured to generate a second data signal corresponding to the second display area.

According to the exemplary embodiment, the first and second data signal generators may be independently turned on/off according to the non-display period of the corresponding display area.

According to the exemplary embodiment, when the first display area is turned off to display a black image, the second display area may be turned on to display an image.

Another exemplary embodiment of the present invention includes a method of driving a display device, the display device including a display unit divided into a plurality of display areas, that are configured to be independently turned on/off, the method including: supplying a scan signal and a data signal to the display unit; and displaying an image corresponding to the data signal, in which when only a first portion of the plurality of display areas displays the image, the data signal from a data signal generator is supplied to first data lines through a first buffer unit to the first portion of the display areas that is set to have a display period, and a black data signal is supplied to second data lines by a sub driver for a second portion of the display areas that is set to have a non-display period.

According to the exemplary embodiment, a second buffer unit allocated to the second portion of the display areas may be turned off when the black data signal is supplied to the second data lines during the non-display period.

According to the exemplary embodiment, the black data signal may be supplied to the second data lines of the second portion of the display areas in a lump.

According to the exemplary embodiment, in the supplying of the black data signal to the second portion of the display areas, an operation of a switch unit for connecting the second data lines of the second portion of the display areas to the sub driver may be controlled.

According to the exemplary embodiment, the connection between the first and second data lines of the first and second display areas and the sub driver may be controlled by supplying a plurality of control signals corresponding to the first and second of display areas, respectively.

BRIEF DESCRIPTION OF THE DRAWINGS

Example embodiments will now be described more fully hereinafter with reference to the accompanying drawings; however, the present invention may be embodied in different forms and should not be construed as limited to the embodiments set forth herein. Rather, these embodiments are provided so that this disclosure will be more thorough and more complete, and will more fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

Further, when a first element is described as "coupled" or "connected" to a second element, the first element may be directly coupled or directly connected to the second element, or may be indirectly coupled or indirectly connected to the second element with one or more other elements interposed therebetween.

Figure 1:
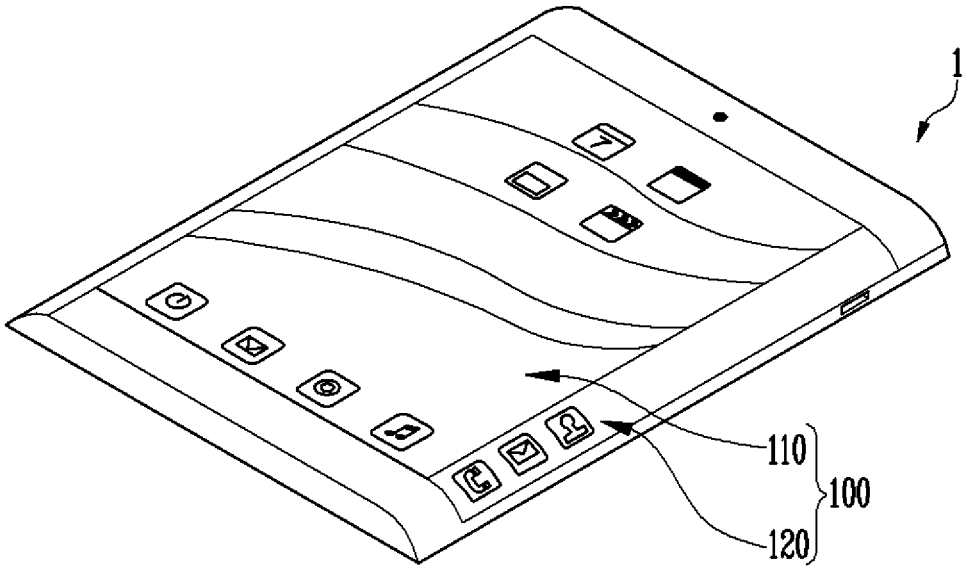

FIG. 1 is a perspective view schematically illustrating an example of a display device including a plurality of independently drivable display areas.

Figure 2:
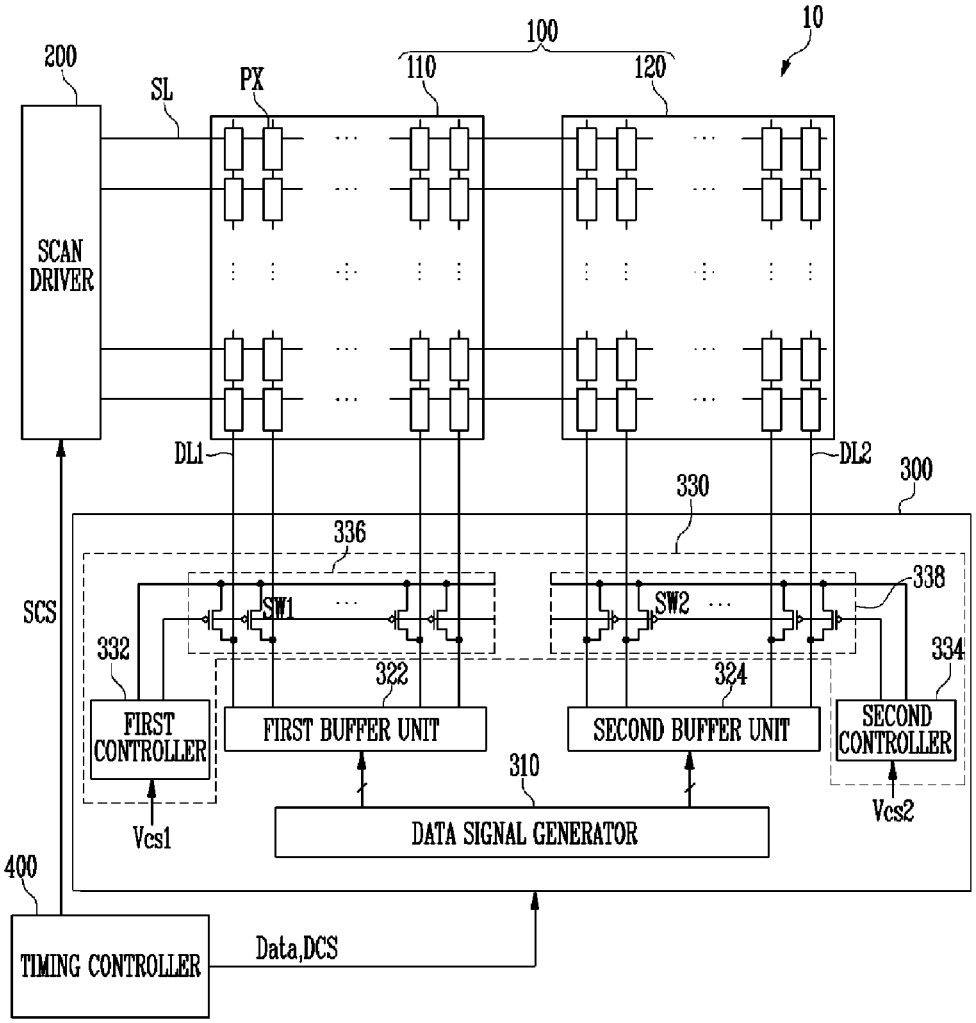

FIG. 2 is a diagram illustrating a display device according to an example embodiment of the present invention.

Figure 3:
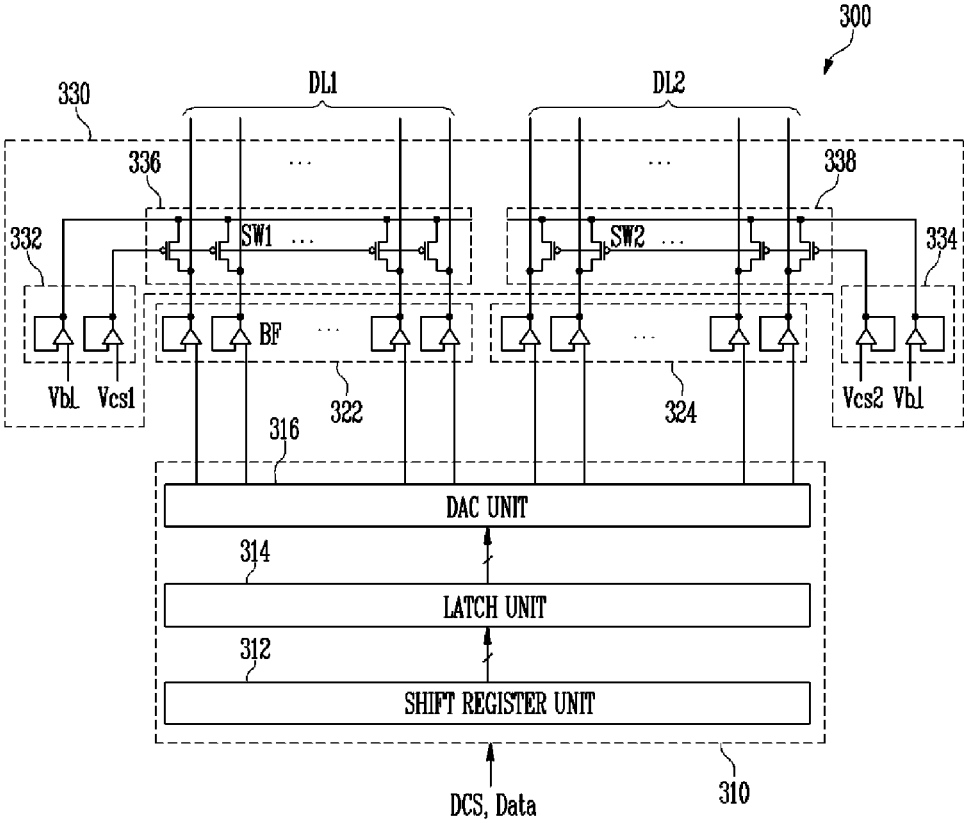

FIG. 3 is a diagram illustrating an example of a data driver illustrated in FIG. 2.

Figure 4:
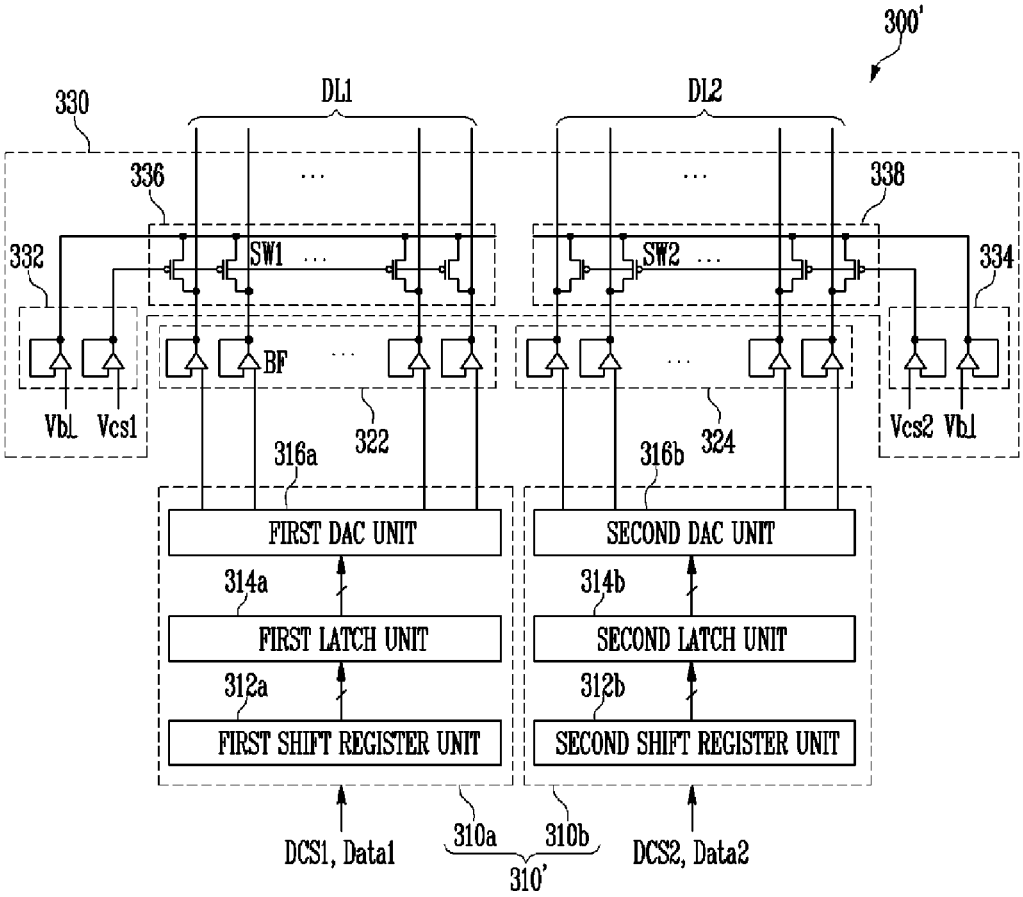

FIG. 4 is a diagram illustrating another example of the data driver illustrated in FIG. 2.

Figure 5:
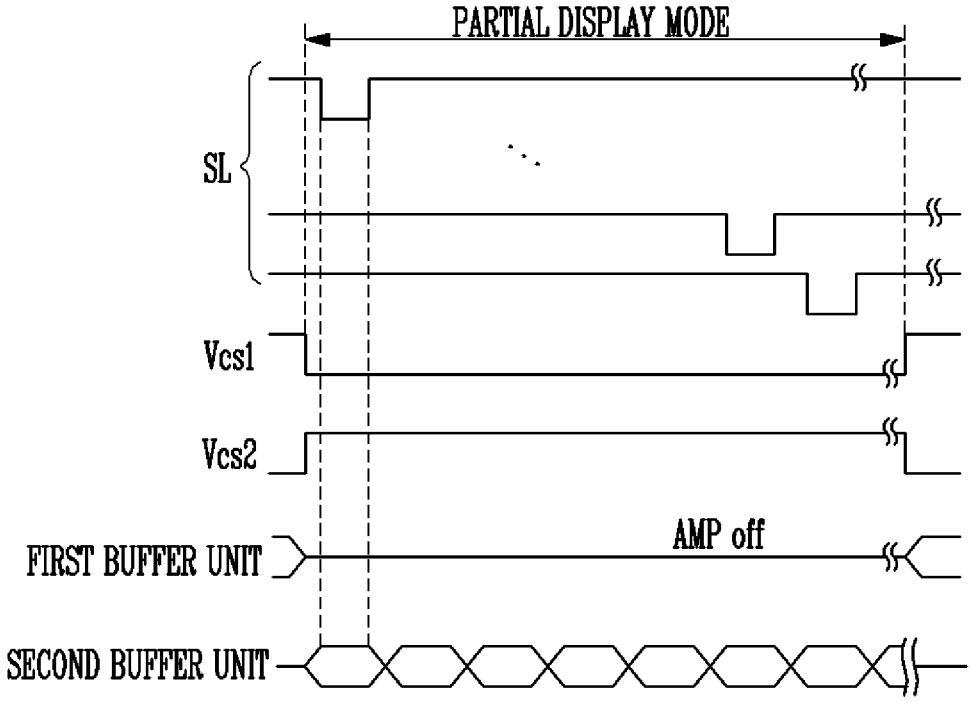

FIG. 5 is a wave form diagram for describing a method of driving the display device according to an example embodiment of the present invention.

DETAILED DESCRIPTION

Hereinafter, example embodiments, based on which those skilled in the art may implement features the present invention, will be described in some detail with reference to the accompanying FIGS. 1 to 5 below.

FIG. 1 is a perspective view schematically illustrating an example of a display device including a plurality of independently drivable display areas. For convenience, FIG. 1 illustrates a display device including two display areas, but the present invention is not limited thereto. That is, the display area may be variously divided into two or more display areas.

Referring to FIG. 1, a display device 1 includes a display unit 100 including a first display area 110 and a second display area 120.

For example, the first display area 110 may be designated as a main display area, and the second display area 120 may be designated as a sub display area.

The first display area 110 and the second display area 120 are designed to be independently drivable. Here, the phrase that the first display area 110 and the second display area 120 are independently drivable generally means that the first display area 110 and the second display area 120 may be at least independently turned on/off.

That is, in the state where any one of the first and second display areas 110 and 120 is turned off, information (e.g., predetermined information) or an image (e.g., a predetermined image) may be displayed only on the other display area, or all of the first and second display areas 110 and 120 may be turned on or off.

In the case where all of the first and second display areas 110 and 120 are turned on, different information or images may be displayed on the first and second display areas 110 and 120, respectively. Alternatively, a screen expansion effect may be provided by using a screen in which the first and second display areas 110 and 120 are coupled with each other to constitute one display area.

When the display unit 100 is divided into the plurality of display areas 110 and 120 as described above, it may be possible to efficiently and variously utilize a screen.

For example, in the case where the display areas 110 and 120 are designed to be independently turned on/off, when an image is displayed on only a portion of the display areas, the remaining display area (or display areas) does not emit light, which may decrease power consumption.

However, even in the case where only a part of the plurality of display areas 110 and 120 is driven, a data signal corresponding to a black grayscale level may need to be supplied for the display area in the off state. To this end, all of the channels of a data driver may need to be fully operational, and thus there is a limit to decreasing power consumption.

Accordingly, embodiments according to the present invention provide a method of turning off a part of a data driver in the case where only a portion of the plurality of display areas 110 and 120 is driven. This will be described in more detail with reference to the example embodiments illustrated in FIGS. 2 to 5.

FIG. 2 is a diagram illustrating a display device according to an example embodiment of the present invention. Further, FIG. 3 is a diagram illustrating an example of a data driver illustrated in FIG. 2.

For convenience, FIG. 2 illustrates a display device including a display unit that is divided into two display areas, but the number of display areas may be variously changed. For example, in some embodiments, the number of display areas may be greater than two. Further, FIG. 2 illustrates the two display area having the same size, but sizes of the display areas or a ratio of the sizes of the display areas may be variously changed.

Referring to FIGS. 2 and 3, a display device 10 according to an example embodiment of the present invention includes a display unit 100 divided into a plurality of display areas 110 and 120, a scan driver 200 for supplying a scan signal to the display unit 100, a data driver 300 for supplying a data signal to the display unit 100, and a timing controller 400 for controlling the scan driver 200 and the data driver 300.

The display unit 100 includes a first display area 110 and a second display area 120, each of which includes a plurality of pixels PX.

For example, the display unit 100 may be divided into the first display area 110 designated as a main display area, and the second display area 120 designated as a sub display area, as illustrated in FIG. 1.

In the meantime, in the example embodiment of the present invention, the first and second display areas 110 and 120 are configured to be independently drivable. More particularly, the first and second display areas 110 and 120 are configured to be independently turned on/off.

For example, an image may be displayed only on the second display area 120 in the state where the first display area 110 is turned off to display a black image, or an image may be displayed only on the first display area 110 in the state where the second display area 120 is turned off to display a black image. Further, all of the first and second display areas 110 and 120 may be turned on to display different images, respectively, or display one connected image, and all of the first and second display areas 110 and 120 may be turned off, so that the display unit 100 may be turned off.

The scan driver 200 generates a scan signal in response to a scan control signal SCS supplied from the timing controller 400, and sequentially supplies the scan signal to scan lines SL. When the scan signal is supplied to the scan lines SL, the pixels PX are selected in a unit of a horizontal line. Further, a data signal is supplied to the pixels PX selected by the scan signal through data lines DL1 and DL2.

The data driver 300 generates a data signal in response to input data Data supplied from the timing controller 400 and a data control signal DCS, and supplies the generated data signal to the pixels PX through the data lines DL1 and DL2.

For example, the data driver 300 according to the present example embodiment includes a plurality of buffer units 322 and 324, which are allocated to the display areas 110 and 120, respectively, and a sub driver 330 for supplying a black data signal to the first or second display area 110 and 120 instead of a turned-off buffer unit when a part of the plurality of buffer units 322 and 324 is turned off.

The data driver 300 according to the present example embodiment includes a data signal generator 310, the first and second buffer units 322 and 324, and the sub driver 330.

For convenience, in the present example embodiment, the sub driver 330 is formed inside the data driver 300, but the present invention is not essentially limited thereto. For example, the sub driver 330 may be formed outside of, or externally with respect to, the data driver 300.

However, when the sub driver 330 is formed inside the data driver 300, as illustrated in the present example embodiment, or is formed inside a driving IC in which the data driver 300 is mounted, embodiments of the present invention may be applied without increasing a dead space of a panel and without requiring a change of a panel.

The data signal generator 310 generates a data signal in response to input data Data supplied from the timing controller 400 and the data control signal DCS.

To this end, the data signal generator 310 may include a shift register unit 312, a latch unit 314, and a Digital-Analog Converter (DAC) unit 316 as illustrated in FIG. 3.

The shift register unit 312 receives a source start pulse and a source shift clock through the data control signal DCS supplied from the timing controller 400 for each horizontal period. The shift register unit 312 sequentially generates a sampling signal by shifting the source start pulse according to the source shift clock. To this end, the shift register unit 312 may include a plurality of shift registers.

The latch unit 314 may include a first latch unit for sequentially latching the input data Data supplied from the timing controller 400 in response to the sampling signal provided from the shift register 312, and a second latch unit for latching data of one horizontal line, which is latched by the first latch part, in parallel in response to a source output enable signal included in the data control signal DCS, and supplying the latched data to the DAC unit 316.

The DAC unit 316 generates an analog voltage corresponding to the input data Data supplied from the latch unit 314, and outputs the generated analog voltage to the first and second buffer units 322 and 324. In this case, the DAC unit 316 may receive gray voltages (for example, V0 to V255 from a gray voltage generator), and generate a plurality of data voltages corresponding to the input data of the respective channels. To this end, the DAC unit 316 may include a plurality of DACs.

In the meantime, in the present example embodiment, the DAC unit 316 supplies a first data signal of the channels corresponding to the first display area 110, and supplies a second data signal of the channels corresponding to the second display area 120 to the second buffer unit 324.

That is, the first data signal corresponding to the first display area 110 among the data signals generated by the data signal generator 310 is supplied to the first buffer unit 322, and the second data signal corresponding to the second display area 120 is supplied to the second buffer unit 324.

The first buffer unit 322 outputs the plurality of first data signals supplied from the DAC unit 316 to the first data lines DL1, and outputs the plurality of second data signals supplied from the DAC unit 316 to the second data lines DL2.

To this end, each of the first and second buffer units 322 and 324 may include a plurality of buffers BF that are coupled to the data lines DL1 and DL2 of the corresponding display areas 110 and 120, respectively. That is, the first and second buffer units 322 and 324 may include the plurality of buffers BF, which correspond one-to-one to the data lines DL1 and DL2. The buffers BF may be configured by, for example, an operating amplifier. The first and second buffer units 322 and 324 are divided so as to correspond to the first and second display areas 110 and 120, respectively, and the first and second data lines DL1 and DL2 and the first and second data signals transmitted through the first and second data lines DL1 and DL2 may be divided so as to correspond to the first and second display areas 110 and 120.

The first and second buffer units 322 and 324 may be separately formed from each other, or be integrally formed.

However, in the present example embodiment, the first and second buffers units 322 and 324 are configured to be independently turned on/off at least, and may be configured to be turned off during a non-display period of the corresponding display area 110 or 120.

For example, only the second buffer unit 324 may be turned on in the state where the first buffer unit 322 is turned off during a partial display mode in which only a portion of the display unit 100 is turned on to display an image, such that the second data signals are output to the second data lines DL2. In this case, the first display area 110 is turned off to display a black image, and the second display area 120 displays an image corresponding to the second data signals.

Similarly, only the first buffer unit 322 may be turned on in the state where the second buffer unit 324 is turned off, such that the first data signals are output to the first data lines DL1. In this case, the second display area 120 is turned off to display a black image, and the first display area 110 displays an image corresponding to the first data signals.

Otherwise, each of the first and second buffer units 322 and 324 may be turned on during a full display mode in which the entire display unit 100 is turned on to display an image, such that the first and second data signals may be supplied to the first and second data lines DL1 and DL2, respectively. In this case, the first and second display areas 110 and 120 display the images corresponding to the first and second data signals, respectively.

Further, each of the first and second buffer units 322 and 324 may be turned off during an off period for which the display unit 100 is generally turned off. In this case, each of the first and second display areas 110 and 120 is turned off, such that a black image is generally displayed on the display unit 100.

For example, in the example embodiment of the present invention, the first or second buffer unit 322 or 324 allocated to first or second display area 110 or 120, which is set to have a non-display period during the partial display mode, is turned off. Further, the buffer unit allocated to the remaining display area, which is set to have a display period during the partial display mode, is turned on to supply the data signal from the data signal generator 310 to the corresponding display area. In this case, instead of the first or second buffer unit 322 or 324, which is in the off state, a black data signal is supplied to the corresponding display area by the sub driver 330.

The first and/or second buffer units 322 and/or 324 may be variously turned off by a method of blocking at least a part of power supplied to the first and/or second buffer units 322 and/or 324, a method of supplying a control signal, which is capable of controlling the first and/or second buffer units 322 and/or 324 to be in the off state, and the like. For example, turning-on/off of the first and/or second buffer units 322 and/or 324 may be controlled under the control of the timing controller 400.

The sub driver 330 supplies the black data signal to the first or second display area 110 or 120 during the non-display period of the first or second display area 110 or 120.

Particularly, the sub driver 330 according to the present example embodiment supplies the black data signal to the first or second display area 110 or 120 instead of the first or second buffer unit 322 or 324, which is set to be in the off state, for the first or second display area 110 or 120, which is set to have the non-display period during the partial display mode.

The sub driver 330 may include, for example, first and second controllers 332 and 334, and first and second switch units 336 and 338. In the meantime, in the present example embodiment, the first and second controllers 332 and 334 are functionally separated and illustrated as different elements, but the first and second controllers 332 and 334 may be integrally designed.

The first controller 332 operates to supply the black data signal to the first display area 110 during the non-display period of the first display area 110 in the partial display mode, and to this end, the first controller 332 supplies a first control signal Vcs1 and a black data signal Vbl to the first switch unit 336 during the non-display period of the first display area 110.

Here, the first control signal Vcs1 may be supplied from the timing controller 400. Further, the black data signal Vbl may be supplied from a constant voltage source having a voltage with a level, with which emission of the pixels may be prevented (or substantially prevented), or may be set to a black gray voltage supplied from the timing controller 400 or the data signal generator 310.

The first controller 332 may supply the black data signal Vdl to the first switch unit 336 together with the first control signal Vcs1, which turns on the first switches SW1, during the non-display period of the first display area 110.

To this end, the first controller 332 may include the plurality of buffers BF for supplying the first control signal Vcs1 and the black data signal Vbl, respectively, to the first switch unit 336 coupled with the first controller 332.

The first switch unit 336 operates to couple the first data lines DL1 of the first display area 110 and the first controller 332 during the non-display period of the first display area 110, and to this end, the first switch unit 336 may include a plurality of first switches SW1 which is turned on in response to the first control signal Vcs1 from the first controller 332.

For example, each of the first switches SW1 may include a first electrode receiving the black data signal Vbl from the first controller 332, a second electrode coupled to the corresponding first data line DL1 of the first display area 110, and a transistor element including a gate electrode receiving the first control signal Vcs1 from the first controller 332.

When the first control signal Vcs1, which turns on the first switches SW1, is supplied from the first controller 332, the first switches SW1 are turned on, and thus, the first data lines DL1 are coupled to the first controller 332. Accordingly, the black data signal Vbl is supplied to the first data lines DL1.

Accordingly, even in the state where the first buffer unit 322 is turned off during the non-display period of the first display area 110, the sub driver 330 may supply the black data signal Vbl to the first data lines DL1 in a lump. Accordingly, power consumption may be effectively decreased.

The second controller 334 operates to supply the black data signal Vbl to the second display area 120 during the non-display period of the second display area 120 in the partial display mode, and to this end, the second controller 334 supplies a second control signal Vcs2 and the black data signal Vbl to the second switch unit 338 during the non-display period of the second display area 120.

Here, the second control signal Vcs2 may be supplied from the timing controller 400. Further, the black data signal Vbl may be supplied from a constant voltage source providing a voltage with a level at which emission by the pixels may be prevented (or substantially prevented), or may be set to a black gray voltage supplied from the timing controller 400 or the data signal generator 310.

The first sub driver 334 may supply the black data signal Vdl to the first switch unit 336 together with the first control signal Vcs1, which turns on the first switches SW1, during the non-display period of the second display area 120.

To this end, the second controller 334 may include the plurality of buffers BF for supplying the second control signal Vcs2 and the black data signal Vbl, respectively, to the second switch unit 338 coupled with the second controller 334.

The second switch unit 338 operates to couple the second data lines DL2 of the second display area 120 and the second controller 334 during the non-display period of the second display area 120, and to this end, the second switch unit 338 may include a plurality of second switches SW2, which are turned on in response to the second control signal Vcs2 from the second controller 334.

For example, each of the second switches SW2 may include a first electrode receiving the black data signal Vbl from the second controller 334, a second electrode coupled to the corresponding second data line DL2 of the second display area 120, and a transistor element including a gate electrode receiving the second control signal Vcs2 from the second controller 334.

When the second control signal Vcs2, which turns on the second switches SW2, is supplied from the second controller 334, the second switches SW2 are turned on, and thus, the second data lines DL2 are coupled to the second controller 334. Accordingly, the black data signal Vbl is supplied to the second data lines DL2.

Accordingly, even in the state where the second buffer unit 324 is turned off during the non-display period of the second display area 120, the sub driver 330 may supply the black data signal Vbl to the second data lines DL2 in a lump. Accordingly, power consumption may be effectively decreased.

The timing controller 400 generates the scan control signal SCS and the data control signal DCS in response to various control signals, such as a vertical/horizontal synchronization signal, a clock signal, and an enable signal supplied from the outside. The timing controller 400 supplies the generated scan control signal SCS and data control signal DCS to the scan driver 200 and the data driver 300, respectively. Further, the timing controller 400 re-arranges the input data Data supplied from the outside and supplies the re-arranged input data to the data driver 300.

In example embodiments of the present invention, the timing controller 400 may further supply the first and/or second control signals Vcs1 and Vcs2 to the first and/or second controllers 332 and 334.

According to the aforementioned example embodiment of the present invention, in the display device including the plurality of independently drivable display areas 110 and 120, the black data signal Vdl is supplied to the display area that is designated to have the non-display period, through the sub driver 330 during the partial display mode of displaying an image only on a partial display area between the plurality of display areas 110 and 120.

Accordingly, even in the state where the buffer unit (for example, the first or second buffer unit 322 or 324) allocated to the display area that is designated to have the non-display period, is turned off, a screen of the corresponding display area may be stably maintained in the off state. Accordingly, power consumption of the display device may be effectively decreased.

FIG. 4 is a diagram illustrating another example of the data driver illustrated in FIG. 2. In describing FIG. 4, the same reference numerals are assigned to the elements which are the same as or similar to those of FIG. 3, and some detailed descriptions of the same or similar elements will be omitted.

Referring to FIG. 4, a data signal generator 310' may be separately configured so as to correspond to first and second display areas 110 and 120, as well as first and second buffer units 322 and 324.

For example, the data signal generator 310' may include a first data signal generator 310*a* for generating first data signals corresponding to the first display area 110, and a second data signal generator 310*b* for generating second data signals corresponding to the second display area 120.

The first data signal generator 310*a* may include a first shift register unit 312*a*, a first latch unit 314*a*, and a first DAC unit 316*a*. The first data signal generator 310*a* may be driven by first input data Data1 and a first data control signal DCS1 of the first display area 110 supplied from the timing controller 400.

The second data signal generator 310*b* may include a second shift register unit 312*b*, a second latch unit 314*b*, and a second DAC unit 316*b*. The second data signal generator 310*b* may be driven by second input data Data2 and a second data control signal DCS2 of the second display area 120 supplied from the timing controller 400.

As described above, in the present example embodiment, the data signal generator 310' is configured to be separated into the first and second data signal generators 310*a* and 310*b* so as to correspond to the first and second display areas 110 and 120, respectively. Then, similar to the first and second buffer units 322 and 324, the first and second data signal generators 310*a* and 31*b* may also be controlled to be independently turned on/off.

FIG. 5 is a wave form diagram for describing a method of driving the display device according to an example embodiment of the present invention. For convenience, in FIG. 5, an example embodiment of the present invention will be described based on the partial display mode in which the first display area is turned off to display a black image, and only the second display area is turned on to display an image.

The method of driving the display device according to the example embodiment of the present invention will be described with reference to FIG. 5 together with FIG. 2. During the partial display mode in which the first display area 110 is set to be turned off, and the second display area 120 is set to be turned on, the first and second control signals Vcs1 corresponding to the first and second display areas 110 and 120, respectively, are supplied to the first and second controllers 332 and 334.

For example, the first control signal Vcs1, which is capable of turning the first switches SW1, is supplied to the first controller 332.

Then, the first controller 332 transmits the first control signal Vcs1 to the first switch unit 336, and the first switches SW1 included in the first switch unit 336 are turned on in response to the first control signal Vcs1.

In this case, the first controller 332 receives a black data signal corresponding to a black gray voltage from a constant voltage source (e.g., a predetermined constant voltage source, or a constant voltage source providing a constant voltage at a predetermined value), the data signal generator 310, or the timing controller 400, and supplies the received black data signal to the first data lines DL1 through the first switches SW1.

That is, in the present example embodiment, an operation of the first switch unit 336 for coupling the first data lines DL1 of the first display area 110 that is set to have the non-display period, to the first controller 332 may be controlled, thereby supplying the black data signal to the first display area 110 in a lump.

Accordingly, the first display area 110, which receives the black data signal from the sub driver 330, is set to be in the off state while displaying the black image.

In the meantime, the first buffer unit 322 allocated to the first display area 110, which is set to have the non-display period in the partial display mode, may be set to be in the off state.

That is, according to the example embodiment of the present invention, in the state where the buffer unit (for example, the first buffer unit 322) allocated to the display area (for example, the first display area 110), which is set to have the non-display period, is turned off, the black data signal may be supplied to the data lines (for example, the first data lines DL1) of the corresponding display area through the sub driver 330 in a lump. Accordingly, power consumption may be effectively decreased.

In the meantime, the second data signals from the data signal generator 310 are supplied to the second display area 120, which is set to have the display period, through the second buffer unit 324.

To this end, the second control signal Vcs2, which is capable of turning off the second switches SW2, is supplied to the second controller 334 during the partial display mode, in which only the first display area 110 is turned off. Accordingly, the second switches SW2 are maintained in the off state.

In this case, the second buffer unit 324 is maintained in the off state, so that whenever the scan signal is sequentially supplied from the scan lines SL, the second data signals from the data signal generator 310 are supplied to the second data lines DL2.

Accordingly, an image corresponding to the second data signals are displayed on the second display area 120.

In the meantime, the waveform diagram of FIG. 5 illustrates the first and second control signals Vcs1 and Vcs2 during a first partial display mode in which only the first display area 110 is turned on to display an image. The first partial display mode occurs before and after a second partial display mode in which only the second display area 120 is turned on to display an image. However, the present invention is not limited thereto, and may be variously modified and implemented.

That is, in the application of the first and second partial display modes, the first and second display areas 110 and 120 are not essentially alternately turned on.

For example, before or after the second partial display mode in which only the second display area 120 is turned on to display the image, the full display mode, in which all of the first and second display areas 110 and 120 are turned on, may occur, or a screen off mode, in which all of the first and second display areas 110 and 120 are turned off, may occur.

The aforementioned method of driving the display device according to the example embodiment of the present invention relates to the method of driving the display device including the display unit 100, which is divided into the plurality of display areas 110 and 120, which may be independently turned on/off.

The method of driving the display device includes an operation of supplying a scan signal and a data signal to the display unit 100, and an operation of displaying an image corresponding to the data signal. However, the method of driving the display device is characterized in that when only a portion of the display areas 110 and 120 displays an image, the data signal from the data signal generator 310 is supplied to the first or second data line DL1 or DLS via the first or second buffer unit 322 or 324 allocated to the corresponding display area for the display area that is designated to have the display period, and the black data signal is supplied to the corresponding data lines through the sub driver 330 for the display area that is designated to have the non-display period.

Accordingly, it may be possible to effectively decrease power consumption of the display device 10 including the plurality of independently drivable display areas 110 and 120.

By way of summation and review, a display device may include a display area is divided into a main display area and a sub display area, which may be independently drivable, such that only the main display area or the sub display area may be selectively turned on/off according to the functionality of the display device. Accordingly, it may be possible to decrease power consumption.

However, even in the case where only some of the plurality of display areas are driven, a data signal corresponding to a black grayscale level may be supplied for the display area in the off state. To this end, all of the channels of a data driver may be fully-operated, which may limit the overall decrease in power consumption.

According to example embodiments of the present invention, in a display device including a plurality of independently drivable display areas, and a driving method thereof, when only some of the plurality of display areas display an image, the sub driver may supply a black data signal to the display area(s) that is set to have the non-display period.

Accordingly, even in the state where the buffer unit of the data driver allocated to the display area that is set to have the non-display period is turned off, a screen of the corresponding display area may be stably maintained in the off state. Accordingly, power consumption of the display device may be effectively decreased.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and their equivalents.

What is claimed is:

1. A display device comprising:

a display unit comprising a first display area and a second display area; and a data driver configured to supply a data signal to the display unit, wherein the data driver comprises:

a data signal generator configured to generate the data signal in response to input data;

a first buffer unit configured to supply the data signal from the data signal generator to the first display area and to be turned off during a non-display period of the first display area;

a second buffer unit configured to supply the data signal from the data signal generator to the second display area and to be turned off during a non-display period of the second display area;

a sub driver configured to supply a black data signal to the first display area during the non-display period of the first display area, and to supply the black data signal to the second display area during the non-display period of the second display area, wherein pixels in the first display area and the second display area that are in a same row share a same scan line and a same scan driver but are separately coupled to the first buffer unit and the second buffer unit, respectively;

a first switch unit;

a second switch unit;

a first controller configured to supply a first control signal and the black data signal to the first switch unit during the non-display period of the first display area, the first control signal configured to turn on the first switch unit and couple data lines of the first display area to the first controller such that the black data signal is supplied from the first controller to the data lines of the first display area; and a second controller configured to supply a second control signal and the black data signal to the second switch unit during the non-display period of the second display area, the second control signal configured to turn on the second switch unit and couple data lines of the second display area to the second controller such that the black data signal is supplied from the second controller to the data lines of the second display area, wherein the second display area is at a curved edge portion of the display unit, and the first and second display areas are at an angle relative to one another.

2. The display device of claim 1, wherein each of the first and second controllers comprise a plurality of buffers configured to supply the first and second control signals and the black data signal to the first and second switch units.

3. The display device of claim 1, wherein each of the first and second switch units comprise a plurality of switches configured to be turned on in response to the first and second control signals from the first and second controllers, respectively.

4. The display device of claim 3, wherein each of the switches comprises a first electrode for receiving the black data signal from the first or second controller, a second electrode coupled to a corresponding data line of the first or second display area, and a gate electrode for receiving a control signal from the first or second controller.

5. The display device of claim 1, wherein the first and second buffer units are independently turned on/off.

6. The display device of claim 1, wherein the data signal generator comprises a first data signal generator configured to generate a first data signal corresponding to the first display area, and a second data signal generator configured to generate a second data signal corresponding to the second display area.

7. The display device of claim 6, wherein the first and second data signal generators are independently turned on/off according to the non-display period of the corresponding display area.

8. The display device of claim 1, wherein when the first display area is turned off to display a black image, the second display area is turned on to display an image.

9. A method of driving a display device, the display device comprising a display unit divided into a plurality of display areas that are configured to be independently turned on/off, the method comprising:

supplying a scan signal and a data signal to the display unit; and displaying an image corresponding to the data signal, wherein when only a first portion of the plurality of display areas displays the image, the data signal from a data signal generator is supplied to first data lines through a first buffer unit allocated to the first portion of the display areas that is designated to have a display period, and a second control signal and a black data signal are supplied to a second switch unit by a second controller of a sub driver for a second portion of the display areas that is designated to have a non-display period, the second control signal turning on the second switch unit, and the second switch unit supplying the black data signal to second data lines, wherein when only the second portion displays the image, the data signal from the data signal generator is supplied to the second data lines through a second buffer unit allocated to the second portion of the display areas that is designated to have a display period, and a first control signal and a black data signal are supplied to a first switch unit by a first controller of a sub driver for the first portion of the display areas that is designated to have a non-display period, the first control signal turning on the first switch unit, and the first switch unit supplying the black data signal to the first data lines, wherein pixels in a first display area and a second display area, from among the plurality of display areas, that are in a same row share a same scan line and a same scan driver but are separately coupled to the first buffer unit and a second buffer unit, respectively, and wherein the second display area is at a curved edge portion of the display unit, and the first and second display areas are at an angle relative to one another.

10. The method of claim 9, wherein the second buffer unit allocated to the second portion of the display areas is turned off when the black data signal is supplied to the second data lines during the non-display period.

11. The method of claim 9, wherein the black data signal is supplied to the second data lines of the second portion of the display areas in a lump.

12. A display device comprising:

a display unit comprising a first display area and a second display area; and a data driver configured to supply a data signal to the display unit, wherein the data driver comprises:

a data signal generator configured to generate the data signal in response to input data;

a first buffer unit configured to supply the data signal from the data signal generator to the first display area and to be turned off during a non-display period of the first display area;

a second buffer unit configured to supply the data signal from the data signal generator to the second display area and to be turned off during a non-display period of the second display area;

a sub driver configured to supply a black data signal to the first display area during the non-display period of the first display area, and to supply the black data signal to the second display area during the non-display period of the second display area, wherein the sub driver comprises a first switch unit connected to only pixels disposed in the first display area and a second switch unit connected to only pixels disposed in the second display area;

a first controller configured to supply a first control signal and the black data signal to the first switch unit, the first control signal coupling data lines of the first display area and the first controller during the non-display period of the first display area such that the black data signal is supplied from the first controller to the data lines of the first display area; and a second controller configured to supply a second control signal and the black data signal to the second switch unit, the second control signal is configured to turn on the second switch unit and couple data lines of the second display area and the second controller during the non-display period of the second display area such that the black data signal is supplied from the second controller to the data lines of the second display area, wherein pixels in the first display area and the second display area that are in a same row share a same scan line and a same scan driver but are separately coupled to the first buffer unit and the second buffer unit, respectively.

* * * * *